US005237757A

United States Patent [19]

Wiedmann et al.

[11] Patent Number: 5,237,757

[45] Date of Patent: Aug. 24, 1993

[54] PROCESS AND APPARATUS FOR THE CONTINUOUS DRYING OF WOOD SHAVINGS, WOOD FIBRES OR OTHER BULK MATERIALS

[75] Inventors: Uwe Wiedmann, Ronneberg; Peter Puppich, Langenselbold; Herbert Krichel; Holger Zierholz, both of Springe, all of Fed. Rep. of Germany

[73] Assignees: Korting Hannover AG; Bison-Werke Bahre & Greten, Fed. Rep. of Germany

[21] Appl. No.: 706,687

[22] Filed: May 28, 1991

[30] Foreign Application Priority Data

Jun. 1, 1990 [DE] Fed. Rep. of Germany ..... 4017806

[51] Int. Cl.[5] ..... F26B 3/00

[52] U.S. Cl. ..... 34/35; 34/86; 34/77; 34/78; 34/79; 110/226

[58] Field of Search ..... 34/22, 35, 86, 79, 72, 34/32, 27, 76–78; 110/224, 226

[56] References Cited

U.S. PATENT DOCUMENTS

| | | | |
|---|---|---|---|
| 4,218,832 | 8/1980 | Daniels | 34/79 |
| 4,715,965 | 12/1987 | Sigerson et al. | 34/79 |
| 4,759,777 | 7/1988 | Balakrishnan et al. | 34/79 |
| 4,780,965 | 11/1988 | Grafen et al. | 34/79 |
| 4,888,884 | 12/1989 | Bartling et al. | 34/79 |
| 4,926,567 | 5/1990 | Ogawa | 34/79 |

FOREIGN PATENT DOCUMENTS 2461415 7/1976 Fed. Rep. of Germany .

*Primary Examiner*—Henry A. Bennet
*Assistant Examiner*—Denise Gromada
*Attorney, Agent, or Firm*—Glen R. Gunewald

[57] ABSTRACT

Drying bulk materials such as wood shavings or wood fibers by contacting the bulk materials with a circulating stream of hot vapor produced by the bulk material drying process, the hot vapor being produced by indirect heat exchange with combustion gas from a fuel-burning combustion chamber, and excess vapor as fuel whereby pollutants are burned before the vapor is discharged into the atmosphere.

13 Claims, 1 Drawing Sheet

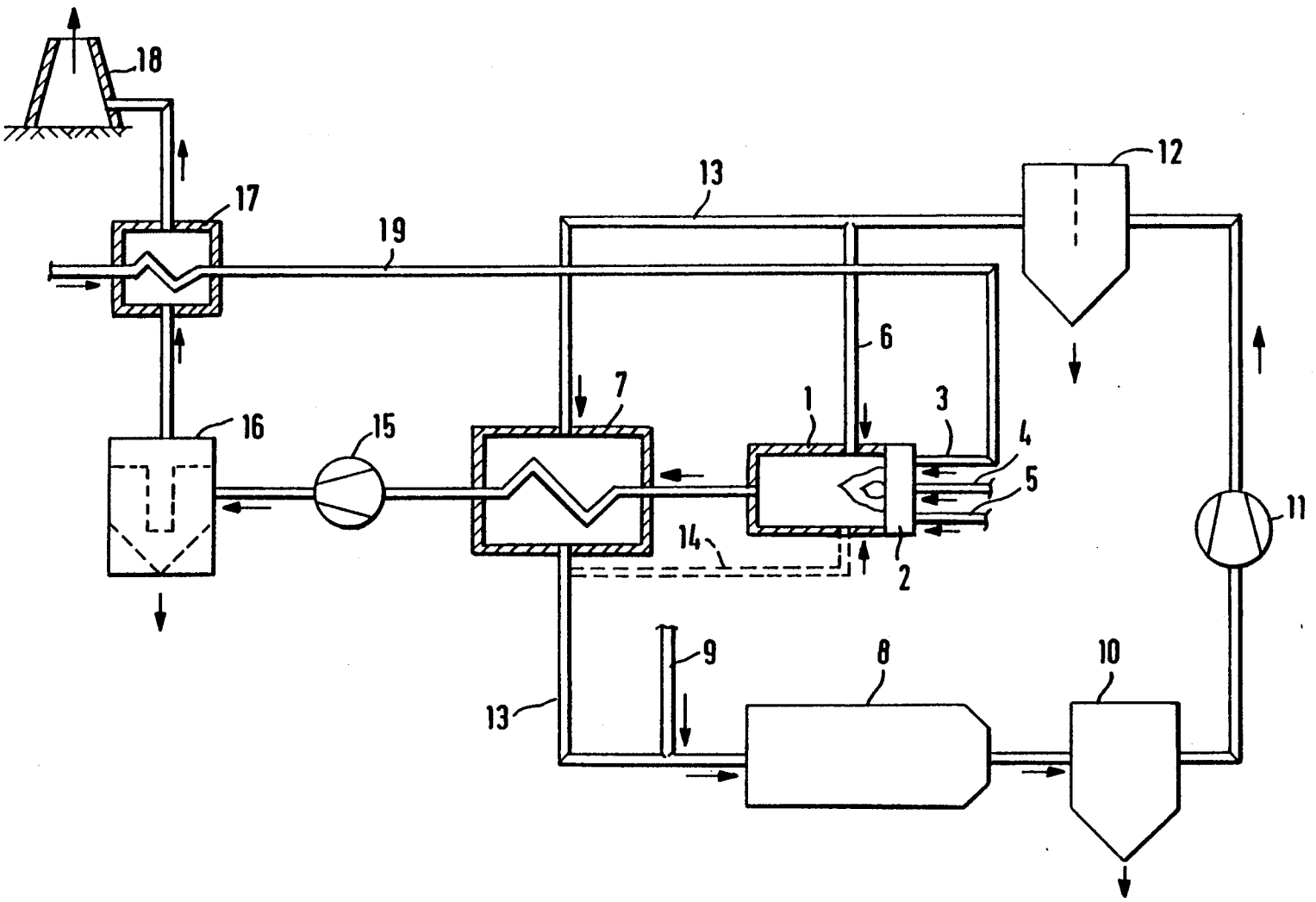
11
12
10
4
5
3
2
6
8
1
13
14
9
7
13
19
15
17
16
18

PROCESS AND APPARATUS FOR THE CONTINUOUS DRYING OF WOOD SHAVINGS, WOOD FIBRES OR OTHER BULK MATERIALS

The invention relates to a process and an apparatus for the continuous drying of wood shavings, chips or fibres or other bulk materials, in which the heat from the combustion gases produced in a combustion chamber is utilized in a drier supplied with the material to be dried.

It is normal practice to introduce the combustion gases directly into the drier. When drying wood shavings, wood fibres or other bulk materials organic pollutants are given off, which are prejudicial to the environment together with the fine dust contained in the combustion gases and vapours. The waste gases leaving the drier must consequently be scrubbed prior to entering the atmosphere. This takes place by dust removal and optionally by further, following purification or scrubbing processes, such as e.g. wet dust removal, electrostatic precipitators, cloth filters, gravel bed filters, chip bed filters and thermal afterburning. Although such purification processes lead to a reduction in emissions, high capital expenditure and operating costs are involved.

DE-OS 24 61 415 discloses a drying plant with a drier directly heated by the combustion gases, which are produced in a combustion chamber located upstream of the drier. The mixture of combustion gases and vapours containing pollutants leaving the drier is purified by means of cyclone dust collecting and is subsequently subdivided into two partial flows. One partial flow is returned to the combustion chamber and fed into the hottest zone of the latter for burning the pollutants, so that there is an intense thorough mixing with the combustion gases and is then supplied to the drier again. The other partial flow is led off into the atmosphere via a waste gas line.

This process has the advantage of a reduced amount of waste gas, so that less pollutants leave the plant, but, in view of the legal emission limitation regulations, still requires the aforementioned, additional purification processes.

The problem of the invention is to provide a process and an apparatus of the aforementioned type enabling pollutant emission limits to be respected which are lower than those prescribed up to now, whilst involving reduced costs and at the same time increasing efficiency and reducing explosion risks.

According to the invention, this problem is solved by a process according to the teaching of claim 1. According to this the pollutant-containing, but combustion gas-free vapours leaving the drier are recycled back to the latter and used as a drying medium for the direct heating of the drier. The enthalpy necessary for this is provided by indirect heating prior to entering the drier. Heating takes place with combustion gases produced in a combustion chamber.

This combustion chamber simultaneously constitutes the "sluice" for a partial vapour flow which, as a result of the mass balance to be maintained in the circuit must be led off from the latter, i.e. pollutants can only leave the circuit via the combustion chamber. They are burned there and in this way supply part of the energy necessary for heating the circuit.

This solution makes it possible without the otherwise necessary additional purification processes, to keep below the legal limits the emissions given off into the atmosphere of both solid and gaseous/condensed organic pollutants. The additional capital expenditure for the indirect heating of the circuit is soon paid off as a result of the hitherto unachieved total purification effect. In addition, these costs are virtually compensated by savings due to the comparatively small equipment parts, such as driers, separators, fans, filtering means and stack. It is particularly advantageous that the circuit in which the vapours travel through the drier, has a very low oxygen content due to the complete exclusion of combustion gases, so that the explosion risk is greatly reduced. The low oxygen content also permits a near-stoichiometric combustion, so that there is a high fuel utilization and therefore high efficiency.

In an advantageous development of the process, prior to the indirect heating, the partial vapour flow is branched off from the circuit. Therefore the vapour quantity to be heated is reduced and simultaneously a further energy carrier is made available in addition to the primary fuels used for producing the combustion gases.

If difficulties are encountered in mixing the relatively cool partial vapour flow in the hot combustion chamber, following the indirect heating of the circuit, a further partial vapour flow can be branched off from the latter and introduced into the combustion chamber. As this partial vapour flow is heated, it can be effectively mixed with the combustion gases. As a result of the mass balance to be respected in the circuit in this case, the first partial vapour flow is reduced by the volume of the second partial vapour flow.

Other advantageous inventive features can be gathered from the further subclaims.

The invention is described in greater detail hereinafter relative to an embodiment and the attached drawing, which is a diagram of an apparatus for the continuous drying of wood shavings, fibres, etc.

In said apparatus a drier 8, a separator 10, a fan 11, one or more cyclones 12 and a recuperative heat exchanger 7 are interconnected by means of pipes. Constructional measures ensure that leaks in the circuit are limited.

The apparatus also has a combustion chamber 1 with a burner 2 which, on the combustion gas side, is connected to the heat exchanger 7, but is not part of the circuit. Supply lines for air 3, light oil or gas 4 and wood dust 5 lead to the burner 2. The fuels can be burned individually or in a random mixture.

The material to be dried is fed into the circuit between the heat exchanger 7 and the drier 8 by means of a not shown material sluice, e.g. a bucket wheel sluice, and a pipe 9. However, the material can also be supplied directly into the entry zone of the drier 8; which is normally a jet tubular drier, a single or multiple feed rotary drier, etc.

In the flow direction upstream of the heat exchanger 7, a pipe 6 to the combustion chamber 1 branches off from the pipe 13 for returning vapours to the drier 8 and which is located between the latter and the cyclone or cyclones 12.

The apparatus functions as follows. The combustion gases produced in the combustion chamber 1 are supplied to the heat exchanger 7. There is an indirect heat exchange there between the hot combustion gases and the relatively cool recycled vapours and as a result the latter are heated to the process temperature necessary for drying the material to be dried. Following this heat exchange process the hot vapour flow is supplied via the portion of the pipe 13 located between the heat exchanger 7 and the drier 8 to the latter for its direct heating. During the drying process further vapours and harmful constituents are released from the material to be dried and are led off from the drier 8 together with the dried material. The coarser fractions of the dried material are separated in the following separator. The fine fractions of the dried material left in the vapours are supplied together with the latter via a blower 11 to one or more cyclones 12, where the fine fractions of the dried material are separated. The vapours leaving the cyclone or cyclones 12 contain fine dust and the pollutants formed during drying. They are returned via the pipe 13 to the drier 8 and pass through the heat exchanger 7, where they are heated. Thus, the approximately inert vapour circuit is closed.

As during the drying process constantly new vapours mixed with pollutants are formed in the circuit, the circulating vapour flow must be continuously reduced as a result of the mass balance to be maintained in the circuit. This takes place by means of the branch line 6 by means of which a partial vapour flow is passed into the combustion chamber 1, where it is burned. If the mixing of the relatively cool partial vapour flow in the hot combustion gases of the combustion chamber 1 is not effective, a further branch line 14 can be led into the combustion chamber 1 and branches off from the circuit behind the heat exchanger 7. The heated vapours carried therein can be more easily mixed with the hot combustion gases of the combustion chamber 1. Due to the mass balance to be maintained in the circuit, the sum of the two partial vapour flows is always the same.

The cooled combustion gases leaving the heat exchanger 7 are fed by means of a fan 15 into a filtering device 16, which is constructed as a dry filter in the form of a bag filter or the like, where they are purified. If ash-free fuel is used, there is no need for this filtering device.

After purification the combustion gases are led into a heat exchanger 17 and used there for preheating the combustion air, which is supplied via pipe 19 to the burner 2. After the heat exchanger 17 the combustion gases are passed into the atmosphere via a stack 18.

The invention is not restricted to the drying of wood shavings, fibres, etc. and can also be used for other bulk materials, such as e.g. fish meal, peat, coal, cerals and sewage sludge.

We claim:

1. The process for drying subdivided wood material which gives off vapor containing organic pollutants during drying, said process using combustion gas produced by burning fuel in a combustion chamber as a heat source for a dryer containing said material, comprising:

contacting said material with heated vapor that is free of combustion gas, said heated vapor being at a temperature that is hot enough to dry said material, to produce a recycle vapor, passing a first portion of said recycle vapor from said dryer into indirect heat exchange with said combustion gas to produce said heated vapor, passing a second portion of said recycle vapor into said combustion chamber as a portion of said fuel.

2. The process of claim 1 wherein said second portion of said recycle vapor comprises a portion of said heated vapor.

3. The process of claim 1 wherein said first portion of said recycle vapor is larger than said second portion of said recycle vapor.

4. The process of claim 1 wherein said combustion chamber operates substantially stoichiometrically.

5. The process of claim 1 wherein said fuel comprises oil.

6. The process of claim 1 wherein said fuel comprises flammable dust.

7. The process of claim 1 wherein said fuel comprises gas.

8. The process of claim 1 wherein said combustion gas is purified with a dry filter.

9. The process of claim 1 wherein residual heat of said combustion gas is used to preheat air for combustion.

10. The process of claim 1 wherein said heated vapor is at a temperature of from about 400° C. to about 600° C.

11. The apparatus for drying subdivided wood material which gives off vapor containing organic pollutants during drying comprising:

a combustion chamber for burning fuel to produce combustion gas, an indirect heat exchanger, a dryer for said material, means to pass said combustion gas to said indirect heat exchanger, means to pass said vapor into said heat exchanger in indirect heat exchange with said combustion gas, means to pass said vapor from said heat exchanger to said dryer, means to pass said vapor from said dryer to said heat exchanger, and means to pass said vapor from said dryer to said combustion chamber.

12. Apparatus of claim 11 including means to pass combustion gas into heat exchange with combustion air, through a filter and to a stack.

13. Apparatus of claim 12 wherein said filter is a dry filter.

* * * * *